US007287307B1

(12) United States Patent
Peterson et al.

(10) Patent No.: US 7,287,307 B1
(45) Date of Patent: Oct. 30, 2007

(54) BURIAL SERVICE ASSEMBLY AND METHOD

(75) Inventors: Michael L. Peterson, Rock Island, IL (US); Tony Manrique, Midlothian, IL (US); Phillip Norder, Homewood, IL (US)

(73) Assignee: Wilbert Funeral Services, Inc., Broadview, IL (US)

( * ) Notice: Subject to any disclaimer, the term of this patent is extended or adjusted under 35 U.S.C. 154(b) by 0 days.

(21) Appl. No.: 11/456,348

(22) Filed: Jul. 10, 2006

(51) Int. Cl.
*A61G 19/00* (2006.01)

(52) U.S. Cl. ..... 27/26; 27/32

(58) Field of Classification Search ..... 27/26, 27/27, 32–35; 52/128, 138, 139
See application file for complete search history.

(56) References Cited

U.S. PATENT DOCUMENTS

| | | | | | |
|---|---|---|---|---|---|
| 714,663 | A | * | 12/1902 | Brannock | 27/26 |
| 919,655 | A | * | 4/1909 | Van Aken | 27/30 |
| 1,520,802 | A | * | 12/1924 | Breckenridge | 27/32 |
| 1,550,127 | A | * | 8/1925 | Tschumperlin | 27/26 |
| 1,801,914 | A | * | 4/1931 | Gibbons | 27/26 |
| 1,928,217 | A | * | 9/1933 | Bruning | 27/26 |
| 2,112,286 | A | * | 3/1938 | Haase | 27/32 |
| 2,130,056 | A | * | 9/1938 | Austin | 27/32 |
| 2,163,173 | A | * | 6/1939 | Haase | 27/32 |
| 2,457,671 | A | * | 12/1948 | Haase | 27/32 |
| 2,523,824 | A | * | 9/1950 | Haase | 52/66 |
| 2,835,956 | A | * | 5/1958 | Moore et al. | 27/32 |
| 3,164,881 | A | * | 1/1965 | Mead | 27/32 |
| 3,364,536 | A | * | 1/1968 | Williams | 27/1 |
| 4,716,636 | A | | 1/1988 | Schneider | |
| 6,393,679 | B1 | | 5/2002 | Ascheman | |
| 6,877,195 | B2 | | 4/2005 | Guillot | |

* cited by examiner

*Primary Examiner*—William L. Miller

(57) ABSTRACT

A burial vault assembly for displaying a vault cover and placing the cover onto a vault base. The assembly has a support structure with a first and second rail secured to the top of a support structure. Each rail has a first portion and a second portion that extends towards the seating area of the burial site and at a downward angle from the first portion. Each rail additionally at the end of its second portion has a stopping element. Thus, a burial cover is moveable along the first and second rails from a sealing position to a display position wherein the vault cover is stopped in place by the stopping element.

16 Claims, 6 Drawing Sheets

BURIAL SERVICE ASSEMBLY AND METHOD

BACKGROUND OF THE INVENTION

This invention relates to burial vaults. More specifically, this invention relates to an assembly for displaying and placing a funeral vault cover onto a vault base.

During a funeral service at a cemetery an assembly is set up that allows a vault cover to be displayed and lowered onto a vault base. Presently this is done using a support system that has tee rails attached thereto that have a cantilevered span that extends away from the attendees in the seating area of the funeral. A pair of cover carriages are then placed on the tee rails such that the tee rails form a track for the cover carriages. The cover carriages are thus secured to the vault cover to allow movement of the cover along the tee rails. Thus, the vault cover is moveable from a position over the top of the vault to a position away from the vault.

Though the system provides a means for placing a vault cover onto a vault base, problems with this system remain. Specifically, many vault covers are adorned with various features and engraving that have been purchased and placed on them by friends and family for displaying purposes. Because the tee rails are parallel to the ground one must be in a position to be able to look down upon the cover in order to be able to observe the features. Additionally, because the system places the vault cover away from the attendees of the funeral, in order for the attendees to observe the display cover they must either walk very close to the grave plot or walk around the grave plot. Furthermore, often the casket and cover are displayed simultaneously and the casket obscures the view of the vault cover adding to the viewing difficulties.

These viewing difficulties cause many problems such as individuals inadvertently causing cave ins by getting too close to the burial plot in order to see the vault cover. Additionally by getting too close to the cover, individuals can accidentally bump or hit the cover causing it to move from its position on the tee rails, and in a worse case scenario cause the cover to fall. Additionally, many times obstacles such as wreathes or flowers that are placed around the burial vault interfere with the ability of an individual to walk around the plot in order to see the vault cover. Thus, this design causes for many instances where embarrassment may fall upon an attendee and makes viewing of the vault cover difficult. In fact, in some instances, attendees even forget to observe the vault cover before leaving the burial area.

Efforts have been made to improve upon this system by angling the tee rails upwardly to slightly tilt the vault cover to facilitate the viewing of the cover. However, this solution also causes its own set of problems. Specifically, because of gravity and the large size and weight of the vault cover, there is difficulty in keeping the vault cover from rolling down the incline. Thus, the incline must be very slight which is not optimal for viewing. Additionally, the weight of the cover often causes the tee rails to straighten and eliminate the incline and view advantage created. Furthermore, when the casket and the cover are displayed simultaneously the casket still continues to block the view of the vault cover. Thus, problems as outlined above remain in that individuals still must walk up to the edge of the grave plot, or around the plot and casket to view the vault cover.

Therefore, it is a primary object of the present invention to provide an assembly for displaying a vault cover and placing the cover on a vault that facilitates the viewing of the vault cover.

Yet another object of the present invention is to provide an assembly for displaying a vault cover and placing a cover onto to a vault that is ascetically pleasing.

Another object of the present invention is to provide an assembly and method for displaying a vault cover and placing the cover upon the vault which improves upon the prior art.

These and other objects, features, or advantages of the present invention will become apparent from the specification and claims.

BRIEF SUMMARY OF THE INVENTION

An assembly for displaying a vault cover and placing the cover onto a vault. The assembly includes a support structure that has a plurality of legs upon which first and second rails are secured. Each of the first and second rails has a first portion extending parallel to the ground and a second portion that extends downwardly from the first portion at an angle of less than 180 degrees. Thus, the vault cover can be secured to first and second cover carriages in order to make the vault cover moveable within the tracks of the rails. Additionally, the second portion of the rails extends towards a seating area such that when the vault cover is on the second portion of the rails individuals in the seating area can observe features and markings that have been adorned on the cover.

DETAILED DESCRIPTION OF THE PREFERRED EMBODIMENT

Figure 1:
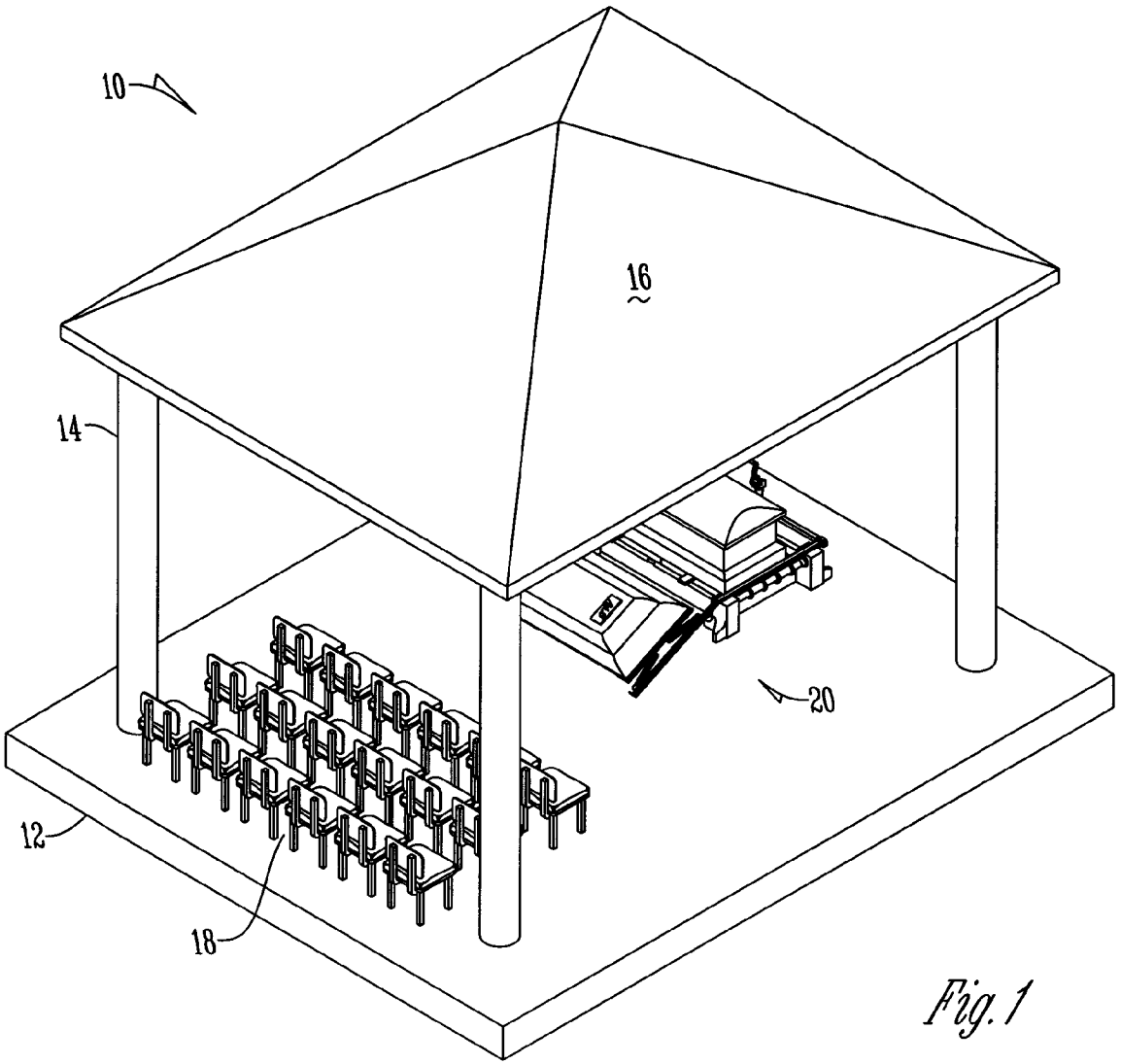
FIG. 1 is a side plan view of a burial vault display assembly within a burial service site.
Figure 2:
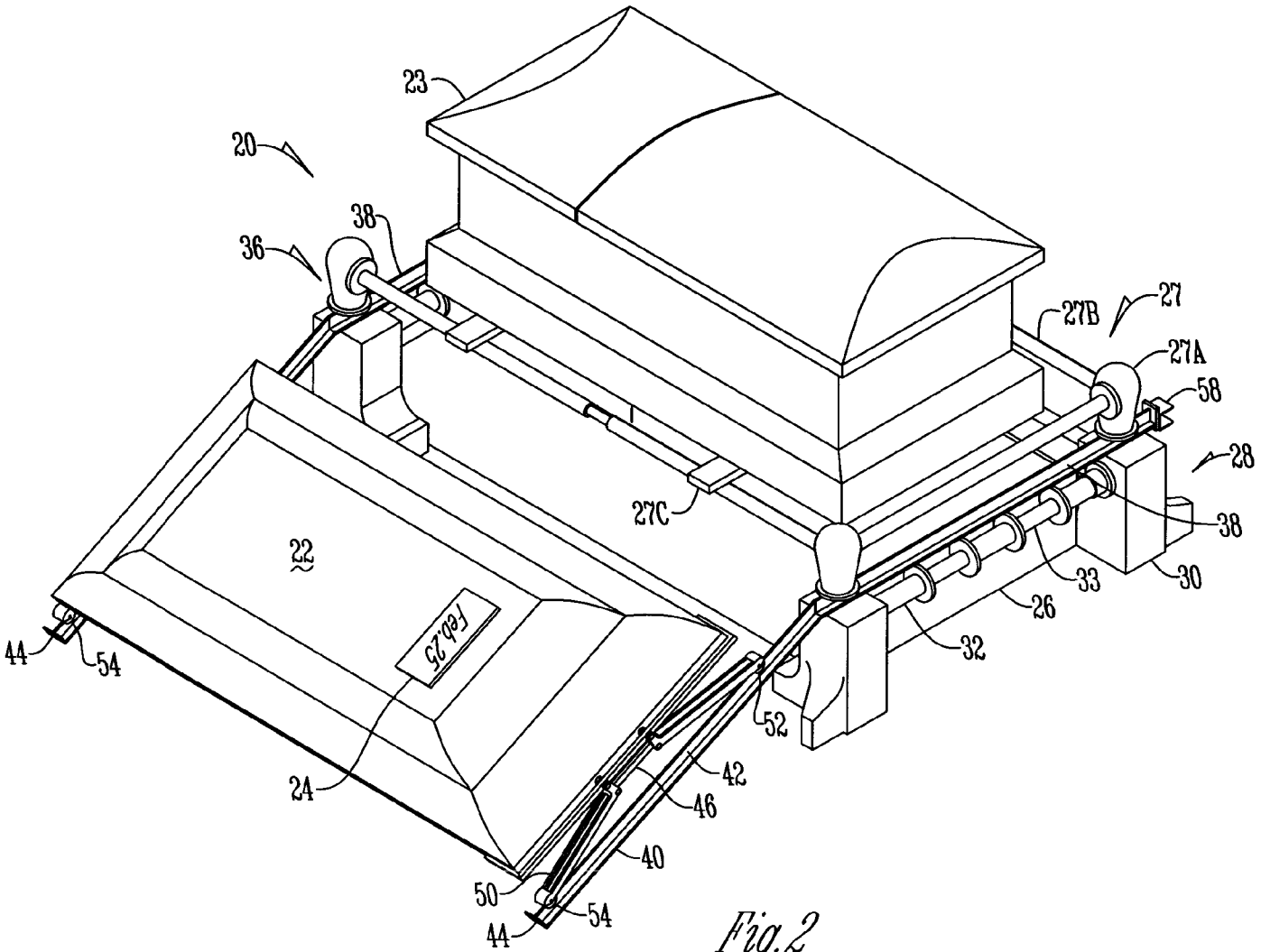
FIG. 2. is a front perspective view of a burial vault display assembly.

FIG. 1 shows a burial service site 10 having a rigid base structure 12. Extending from the rigid base structure 12 is a plurality of supporting members 14 that support a canopy 16. Within the burial service site 10 is a seating area 18 for individuals attending a funeral. Housed within the burial service site 10 is a burial vault display assembly 20 that is used in order to display a vault cover 22 and a casket 23 simultaneously. (See FIG. 2). The vault cover 22 has adoring features 24 such as for example emblems, special engravings, or dates thereon for viewing by attendees and is placed on a vault base 26. As shown in FIG. 2 a casket lowering device is removably placed on the burial vault display assembly for displaying the casket 23. The casket lowering device 27 is comprised of a plurality of decorative posts 27*a* connected with metal tubing 27*b*. A pair of casket holding rails 27*c* extend across the metal tubing 27*b* such that the casket 23 rests upon the casket holding rails 27*c* for viewing.

Figure 3:
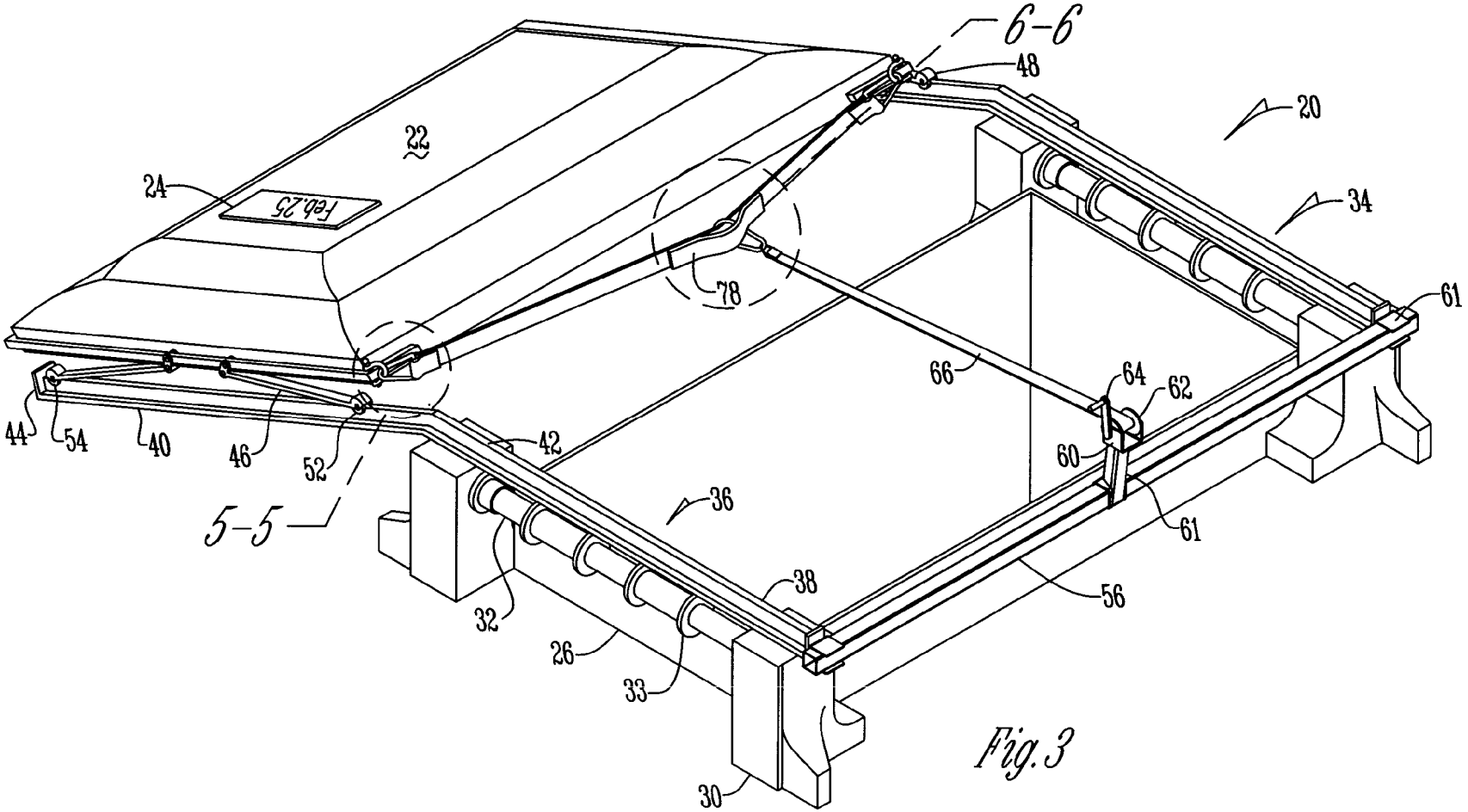
FIG. 3 is a back perspective view of a burial vault display assembly.
Figure 4:
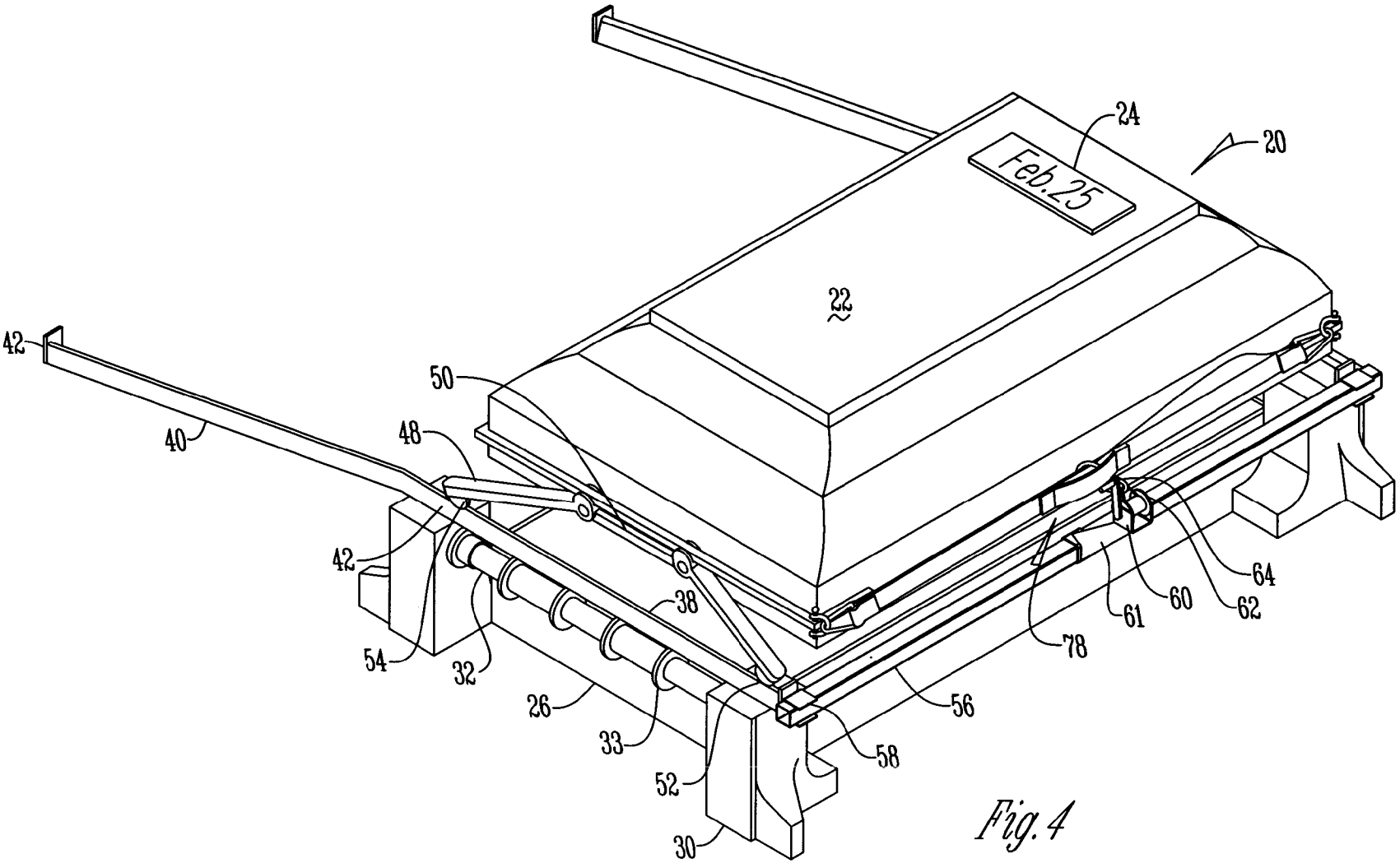
FIG. 4 is a front perspective view of a burial vault display assembly wherein a vault cover is positioned above a vault.

As best shown in FIGS. 2-4 the burial vault display assembly 20 has a support structure 28 that comprises a plurality of leg members 30. In a preferred embodiment the vault base 26 is rectangular in shape and four legs members 30 are placed adjacent each corner of the vault 26. Alternatively, other arrangements are contemplated and the legs 30 may be positioned around the vault base 26 accordingly.

Extending between and secured to a pair of leg members is rotatable shaft 32 having a pair of moveable spools 33 disposed around said rotatable shaft 32. The shaft 32 and spool 33 assembly is used in association with a cable (not shown) in order to place the vault cover 22 on the vault base 26.

Secured to the support structure 28 are first and second rails 34, 36 respectively. In a preferred embodiment the first and second rails 34, 36 are secured to the tops of a pair of leg members 30. The first and second rails 34, 36 have first and second portions 38, 40 respectively. In a preferred embodiment the first and second rails 34, 36 are tee rails with cantilevered downward bent spans that form a track 42. Additionally, in a preferred embodiment the rails 34, 36 have first portions that extend over the supporting frame 28 and second portions 40 that extend from adjacent the supporting structure 28 downwardly from said first portion 38 at an angle less than 180 degrees. The second portions 38 terminate at stopping elements 44 that impede the movement of first and second cover carriages 46, 48 placed within the track of the rails 34, 36. Thus, in this embodiment the rails are always within the same parallel plane.

The first and second cover carriage 46, 48 have inverted U-shaped bodies 50 that are secured to the vault cover 22 such that the vault cover 22 extends between the first and second cover carriages 46, 48. Each U-shaped body 50 terminates in a first and second wheel 52, 54 that engage the track 42 of the first and second rails 34, 36. Thus, the vault cover 22 is moveable along the rails 36, 38 such that the vault cover 22 moves from a display position as best seen in FIGS. 2-3 to a sealing position as best seen in FIG. 4. Additionally, the stopping elements 44 impede the movement of the cover by stopping the movement of the cover carriages 46, 48.

A removable back support shaft 56 can optionally be detachably connected to the first and second rails 34, 36 with sleeve elements 58. Secured to the back support shaft 56 is a centrally located winch 60 that is aligned with the vault cover 22 with an arm stand 61. In one embodiment the arm stand 61 is made of aluminum. In a preferred embodiment the back support shaft is made of steel tubing. The winch 60 has a pulley member 62 that is rotatably connected to a lever 64 such that when the lever 64 rotates a strap 66 within the pulley 62 either wraps around the pulley 62 or unravels from the pulley 62 depending on the direction of the rotation.

Figure 5:
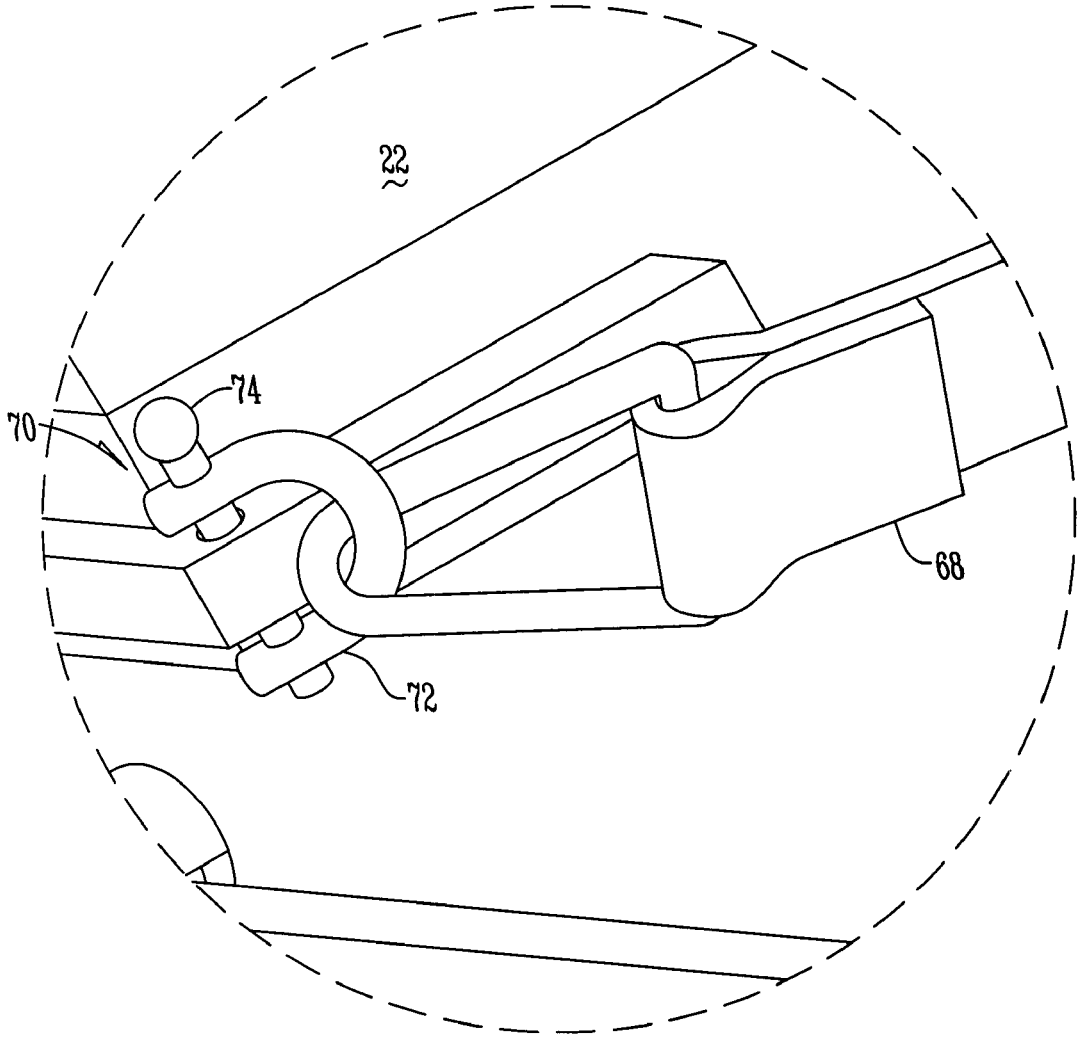
FIG. 5 is an exploded perspective view of a shackle taken from FIG. 3 along dotted lines 5-5.
Figure 6:
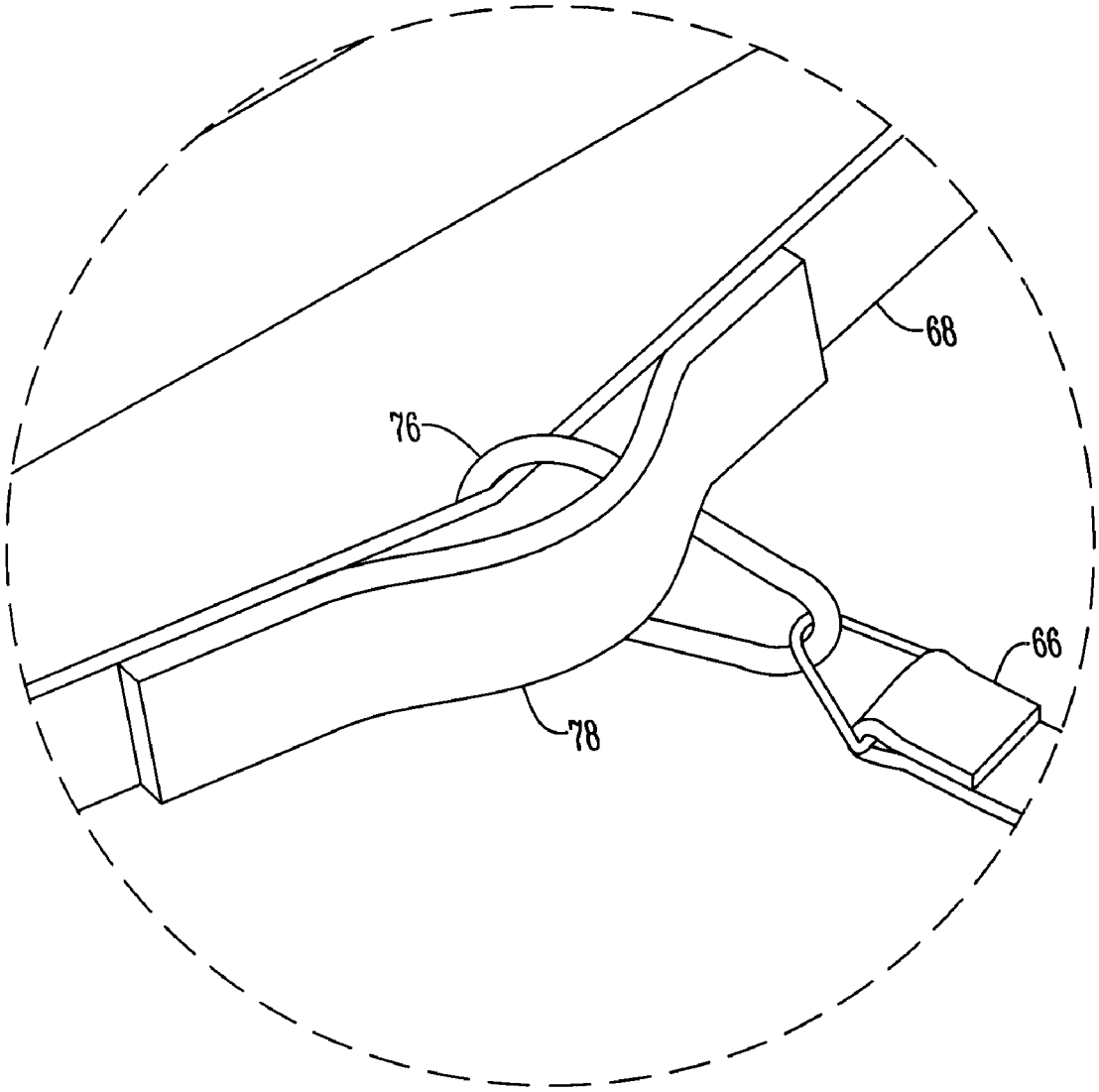
FIG. 6 is an exploded perspective view of a D-ring taken from FIG. 3 along dotted lines 6-6.

Secured to the cover carriages 46, 48 is a sling 68 with a shackle 70 having a U-shaped body 72 and a pin member 74 that is disposed through the U-shaped body and cover carriages 46, 48 in order to secure the sling 68 to the cover carriages 46, 48. (See FIG. 5). Thus, the strap 66 of winch 60 is mechanically connected to the sling 68 secured to the cover carriages 46, 48 such that when the lever 64 of the winch 60 is rotated in a first direction the vault cover 22 is moveable towards the winch 60. In a preferred embodiment as best shown in FIG. 6 the mechanical connection between the strap 66 and sling 68 comprises a D-ring 76 that is attached to the strap 66 and is disposed through a loop 78 used to center the D-ring 76 on the sling 68.

In operation, before attendees of a funeral gather, the support structure 28 is placed around the burial plot such that the second portion 40 of rails 34, 36 extend toward the seating area 18 of the burial service cite 10. The vault cover rests on the first and second rails 34 and 36 above the vault base 26 at what is considered a sealing position. The removable back support shaft 56 is then attached to the first and second rails 34 and 36 and the winch 60 is attached to the first and second cover carriages 46 and 48 to hold the vault cover 22 in place without assistance of individuals.

As the winch 60 is rotated the first and second cover carriages 46 and 48 move along the second portion 40 of the first and second rails 46 and 48. As the first and second cover carriages move along the first and second rails 46 and 48 the winch 60 brakes the rolling action to stop the first and second cover carriages 46 and 48. Thus the winch 60 is able to hold the vault cover 22 without assistance from an individual, and provide a continuous brake to the cover carriages 46 and 48 to ensure the vault cover 22 is safely moved until the cover carriages 46 and 48 rest against the stop elements 44. Therefore, the first and second cover carriages 46, 48 have the vault cover 22 secured therebetween and have the front wheels 54 in frictional engagement with the stop elements 44 on the second portion 40 of the first and second rails 36, 38. At this time the vault cover 22 is in the display position as best shown in FIGS. 2-3.

Once the vault cover 22 is in its display position the casket lowering device 27 is placed on the first portion 38 of the rails 34, 36 and the casket 23 is placed on the casket holding rails 27*c*. Thus the vault cover 22 and casket 23 are displayed simultaneously and can both be easily viewed from the seating area 18.

After attendees, or mourners, have gathered and the viewing of the vault cover 22 and casket 23 is complete, the casket 23 is lowered into the vault base 26. Next the vault cover 22 is placed in its sealing position as best seen in FIG. 4. To accomplish placing the vault cover 22 in its sealing position the back support shaft 56 is attached to the first and second rails 34, 36. Next the sling 68 is detachably secured to the cover carriages 46, 48 with the shackles 70. Then the D-ring 76 of the strap 66 of winch 60 is attached to the sling 68. Once the strap 66 of winch 60 is attached to the sling 68 the winch 60 is rotated with lever 64 to move the vault cover 22 into its position above the vault 26. (FIG. 4). Thus, the vault cover 22 is in position to be sealed to the base by the rotatable shaft 32 and spools 33 by raising the vault base 26.

By having the second portion 40 of the rails 34, 36 extend downward individuals within the seating area 18 may easily see adorning features 24 on the vault cover 22 simultaneously with a casket 23. Additionally, the adorning features 24 are seen without having to walk near the burial plot or without fear of accidentally hitting the vault cover 22 and moving it along the rails 34, 36. Additionally, individuals no longer have to walk around the support structure 28 in order to properly view the cover 22 avoiding tripping over objects or knocking over objects such as flowers that could cause embarrassment to the attendee. Additionally, with use of the winch 60 the vault cover 22 is easily moved from a display position to a sealing position and because the back support shaft 56 is removable the winch system 60 is attached after viewing is finished to keep in tact the integrity of the viewing and display process. Consequently, at the very least, all of the stated objectives have been met.

It will be appreciated by those skilled in the art that other various modifications could be made to the device without the parting from the spirit in scope of this invention. All such modifications and changes fall within the scope of the claims and are intended to be covered thereby.

What is claimed is:

1. An assembly for displaying a vault cover and placing the vault cover onto a vault base comprising:

a support structure;

first and second rails secured to the support structure;

each of the first and second rails comprising a first and second portion, said first portions being placed over said supporting structure, said second portions extending from said first portions; and said second portions being angled downwardly from said first portion at an angle less than 180 degrees such that the vault cover moves along said rails.

2. The assembly of claim 1 wherein the rails are tee rails.

3. The assembly of claim 1 wherein the vault cover is moveable along the rails via a first and second cover carriage.

4. The assembly of claim 1 wherein the second portions have first and second stop elements for impeding the movement of the vault cover.

5. The assembly of claim 1 further comprising a support member extending between and removably connected to the first portions of the rails.

6. The assembly of claim 5 wherein the support member is steel tubing.

7. The assembly of claim 5 further comprising a winch having an elongated strap secured to the support member.

8. The assembly of claim 7 further comprising a sling mechanically connected to the vault cover and mechanically connected to the strap of the winch such that when the winch is operated the vault cover is moved between a display position and a sealing position.

9. The assembly of claim 8 wherein the sling is mechanically connected to the vault cover with a shackle that comprises a U-shaped fastener with a pin member disposed through a portion of the cover carriages and the U-shaped shaped fastener.

10. The assembly of claim 8 wherein the sling is mechanically connected to the strap with a D-ring.

11. A method of displaying a vault cover and placing the vault cover onto a vault base steps comprising:

providing a seating area for mourners;

proving a support structure at a spaced distance form the seating area;

securing first and second rails to the support structure;

each of the first and second rails comprising a first and second portion;

extending the second portions toward the seating area and downwardly;

moving the vault cover along the rails onto the second portion of the rails; and stopping the movement of the vault cover with stop elements.

12. The method of claim 11 wherein the rails are tee rails.

13. The method of claim 11 wherein the vault cover is secured to first and second cover carriages that move within the rails.

14. The method of claim 11 further comprising the step of placing a casket on the first portions of the rails.

15. The method of claim 14 wherein the casket is placed on the first portions of the rails by placing a casket lowering device on the first portions of the first and second rails and placing the casket on the casket lowering device.

16. The method of claim 11 further comprising the steps of:

attaching a winch to the support structure and the vault cover; and pulling the vault cover away from the seating area to place the vault cover over the vault base.

* * * * *